United States Patent [19]

Boissicat

[11] 4,423,815

[45] Jan. 3, 1984

[54] COMPONENT SORTING APPARATUS

[75] Inventor: Claude M. Boissicat, Cupertino, Calif.

[73] Assignee: Contrel Corporation, Sunnyvale, Calif.

[21] Appl. No.: 291,253

[22] Filed: Aug. 10, 1981

[51] Int. Cl.[3] ..... B07C 9/00; B07C 5/344

[52] U.S. Cl. ..... 209/655; 209/573; 414/27

[58] Field of Search ..... 209/573, 574, 571, 655, 209/539, 542, 909, 919; 29/593; 414/27

[56] References Cited

U.S. PATENT DOCUMENTS

| | | | |
|---|---|---|---|
| 3,265,208 | 8/1966 | Reniker et al. | 209/655 X |
| 3,662,881 | 5/1972 | Fineran | 209/655 |
| 3,716,135 | 2/1973 | Sears et al. | 209/655 |
| 3,727,757 | 4/1973 | Boissicat | 209/655 X |
| 3,731,796 | 5/1973 | Smith | 209/655 X |
| 3,896,935 | 7/1975 | Hjelle et al. | 209/573 |
| 4,234,418 | 11/1980 | Boissicat | 209/573 |
| 4,258,850 | 3/1981 | Solaroli | 209/655 |

FOREIGN PATENT DOCUMENTS

| | | | |
|---|---|---|---|
| 2855913 | 6/1980 | Fed. Rep. of Germany | 209/573 |

*Primary Examiner*—Robert B. Reeves

*Assistant Examiner*—Donald Hajec

*Attorney, Agent, or Firm*—Hamrick, Hoffman & Guillot

[57] ABSTRACT

A component sorting apparatus (110), (210) having a shuttle carrier (142), (278) on which are provided a pair of shuttle rails (116), (118) and (216), (218) spaced from one another in fixed relation a distance determined by the spacing between any two contiguous paths (122), (222) of an output tray (120), (220) associated with the shuttle carriage. By this arrangement, each of the rails of the shuttle (114), (214) need travel only one half of the width of the associated output tray; a distance corresponding to roughly one half of the number of outputs, depending on whether there are even or odd number of same. It is proposed to employ either a slide-crank mechanism (164), (166), (170) or a capstan/encoder drive system (306) for reciprocating the dual shuttle (114), (214), largely depending on the number of output paths provided in the apparatus. The shuttle according to the invention permits relatively large integrated circuits and other like-components to be sorted, making advisable the use of a positive advancing system in the output arrangement of the apparatus to prevent damage which may result due to the momentum resulting when such larger components are allowed to move under the influence of gravity on their substantial mass.

11 Claims, 17 Drawing Figures

COMPONENT SORTING APPARATUS

BACKGROUND OF THE INVENTION

1. Field of the Invention

The present invention relates generally to apparatus for sorting large numbers of components, and more particularly to a device for sorting electronic components from a single input into several outputs.

2. Description of the Prior Art

Automated apparatus is known for handling large numbers of electronic components such as dual-in-line packages (DIP), single in-line packages (SIP), small outline components (SO), leadless chip carriers (LCC), and the like. Generally, these automated devices usually consist of an input section into which the components are fed, a station where the components are tested or marked, and a sorting or distributing section where the components are sorted or distributed into one of several categories. Generally, the sorting and distributing portions of the known handlers use one of several known sorting techniques. Among these techniques is the use of a moving chute or arm which is pivoted at an input end and swings so as to place its output end at a selected station to which a component is to be fed. A primary disadvantage of this technique is that the component has to rotate when it is transferred onto the arm from an input to the device, thus usually limiting the number of possible output stations to less than eight and also limiting the size of components which can be used with the device. Another known technique for sorting components is to use a rotatably mounted wheel having nests or pockets evenly distributed on the periphery thereof into which components can be loaded and the wheel indexed so that the components are ejected when they face a desired output station. This technique that is usually used for components such as transistors, and the like, handled in bulk is unattractive for components which are handled in tubes, sleeves, magazines, and the like, as the orientation of such components must be conserved during handling. Therefore, due to the various attitudes of the components as they exit the rotating wheel, some reorienting mechanism must be used in conjunction with the wheel if integrated circuits and like components are to be sorted by this technique.

Other known techniques for sorting semiconductor devices include the cascade technique wherein several flaps are placed in line and are actuated individually to divert components into selected outputs. A disadvantage of this technique is the pronounced rotation the components have to achieve when entering a selected output station, thus limiting the application of such devices to relatively small components. Another disadvantage of the cascade technique is the necessity of distributing the output stations in a vertical plane, which results in the unloading process being cumbersome. The transfer chain or belt technique loads components into nests or pockets evenly distributed on a chain or belt which is indexed once per handler cycle. A component is ejected when it faces a predetermined one of a plurality of outputs. A primary disadvantage of this method is found in the relatively low reliability of chain or belt mechanisms, and the necessity of using relatively complex mechanical ejecters for removing the components from the chain or belt.

Finally, it is known to sort electronic components by use of a shuttle which is horizontally moved at high speed between an input and a number of output stations once per handler cycle. For example, my prior U.S. Pat. No. 4,234,418, issued Nov. 18, 1980, discloses apparatus in which components initially are reoriented so as to be received from the device in the same orientation as which they are inserted. The components then are metered into a test head station for testing, and ultimately are transported to an output tray by a shuttle device which receives the components from a single track leading from the test station and discharges the component to a particular track of the output tray as a function of the results of tests performed on the component at the test station.

The shuttle incorporated in the handling apparatus disclosed in my U.S. Pat. No. 4,234,418 includes a carriage slideably mounted on a pair of substantially parallel rods forming straight bearings so as to slide between the output track from the test station and the substantially parallel plural tracks of the output tray in a direction substantially perpendicular to the paths of movement formed by these tracks. A single rail is provided on the carriage of the shuttle, such that the carriage must move to the output tray from a position distant from the test station, so as to receive a component to be sorted, and then move to a position in alignment with a particular one of tracks of the output tray onto which the component is to be discharged. The shuttle carriage, which is arranged centrally of the plurality of substantially parallel tracks of the output tray, is driven by a capstan and encoder arrangement wherein the capstan is mounted on the output shaft of a suitable electric motor whose rotation is controlled by the encoder. A pair of belts or straps are connected to the capstan and wrapped around the generally cylindrical outer surface of same in opposite directions, with one end of each of the belts being attached to the shuttle carriage and the other end being attached to respective one of the remote ends of a rod extending from the shuttle carriage. Since the shuttle carriage must move the entire width of the output tray, the maximum width of the shuttle when the shuttle carriage is at its extreme position in the direction of extension of the rod from the shuttle carriage will be at least twice the width of the output tray. Thus, not only does the use of a single rail on the shuttle carriage require the shuttle to operate at a very high rate of speed in order to move from a position centrally of the output tray to one of the extreme positions relative to the tray within the time limitations placed on such movement by displacement of the component being sorted, but the overall shuttle unit is physically rather bulky. In the specific shuttle disclosed in U.S. Pat. No. 4,234,418, the extreme width requirements result in the article handling compartment of the unit having insufficient width to house the entire shuttle. Consequently, it was necessary to provide a window in a perpendicular surface of a support chassis of the handling apparatus in order to permit the shuttle to extend from the handling area of the apparatus to an electronic control portion thereof. This arrangement creates many operational and maintenance problems, in addition to taking up valuable space in the control portion of the apparatus. Further, the relatively long distance the shuttle has to travel requires a relatively large motor for driving it, since the greater the distance the shuttle carriage must cover the greater power is required to move the carriage within the time limitations imposed.

Accordingly, there is a need for a more compact shuttle unit which will fit into a space no wider than the associated output tray and which will be more energy efficient when compared with the known shuttle.

SUMMARY OF THE PRESENT INVENTION

It is an object of the present invention to provide component sorting apparatus including a shuttle having a width which is not substantially greater than the width of an associated output tray to which the shuttle is feeding components.

It is another object of the present invention to provide a component sorting apparatus incorporating a dual shuttle construction in which each shuttle rail travels no more than half the width of an output tray associated with the shuttle.

Yet another object of the present invention is to provide a dual shuttle system which can be applied to a wide variety of shuttle constructions and output tray sizes.

Briefly, the present invention preferably comprises a shuttle carriage on which are provided a pair of shuttle rails spaced from one another in fixed relation a distance determined by the spacing between any two contiguous outputs of an associated output tray. In this manner, each of the rails of the shuttle need travel only one half of the width of the output tray; a distance corresponding to roughly one half of the outputs, depending on whether there are an even or odd number of same, as opposed to the entire width of the output arrangement. It is proposed to employ either a slide-crank mechanism or a capstan/encoder drive system for reciprocating the dual shuttle, largely depending on the number of output paths provided in the apparatus. Since the tracks, rails, and slides of the sorting apparatus according to the invention are capable of receiving the larger integrated circuits, and the like, it is desirable that such units be positively driven down the slides rather than under gravity movement so as to prevent the components from moving too rapidly and damaging themselves when they are stopped at the bottom of the output arrangement. Accordingly, an advancing system is provided in which pins are arranged in slots extending longitudinally along upwardly convexly curved sections of the output slides of the apparatus so that when the pins are reciprocated from one end of the the slots to the other, they will pass beneath an upwardly directed surface of the associated slides adjacent the input end of the section of the slide in order to clear the way for a component to be moved in a backward stroke and subsequently move the component down the slide with a forward or return stroke. This will assure that the components are moved along the lower portions of the output slides at a speed which will prevent damage to the components when they are stopped at the bottom of the slides.

An advantage of the present invention is that a component sorting shuttle need be no wider than an output tray or slide arrangement associated with the shuttle, thus providing a more compact, yet rigid and easily aligned, unit.

Another advantage of the present invention is that a motor driving the dual shuttle need be only about one half the size of a motor needed to drive a single rail shuttle, thus providing for more energy efficient operation.

Still another advantage of the present invention is that the larger sized integrated circuits can be readily handled without risk of damage to the components.

These and other objects and advantages of the present invention will no doubt become apparent to those skilled in the art after having read the following detailed description which makes reference to the several figures of the drawing.

IN THE DRAWING

FIGS. 1*a* and 1*b* are diagramatic charts showing relative positions between a dual shuttle according to the present invention and an output arrangement having eight output paths;

FIG. 2 is a diagramatic chart showing relative positions between a dual shuttle according to the present invention and an output arrangement having five output paths;

FIGS. 3*a* and 3*b* are diagramatic charts showing the relative positions between a dual shuttle according to the present invention and an output arrangement having three output paths;

DESCRIPTION OF THE PREFERRED EMBODIMENTS

Discussion of Underlying Principles

The present invention sorts components, such as integrated circuits, which are fed from a single input into a dual shuttle which is controlled so as to travel linearly and discharge the components to selected ones of a plurality of output paths.

Let "L" be the number of output paths.

Let "S" be the constant spacing between any two contiguous output paths.

Let "D" be the distance between the two center lines of the two rails of the shuttle.

Let "P" be the number of positions of the shuttle; a position being defined by the alignment between one of the two rails of the shuttle and one output paths.

Let "T" be the total travel of the shuttle when the shuttle moves from the leftmost position, designated Position No. 1, to the rightmost position, designated Position No. "P."

Then:

With L=2N, the number of output paths is even, the input is centered between output paths N and N+1, and the following holds true:

$$D=(N-\tfrac{1}{2})\times S$$

$$T=(N-\tfrac{1}{2})\times S$$

$$P=2N$$

With L=2N+1, the number of output paths is odd, the input is centered with output path N+1, and the following holds true:

$$D=N\times S$$

$$T=N\times S$$

$$P=N+1$$

Several examples will now be set forth to show how the above relationships are applied.

Figure 1A:
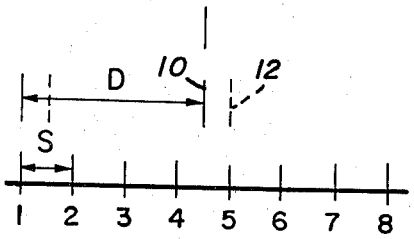
Figure 1B:
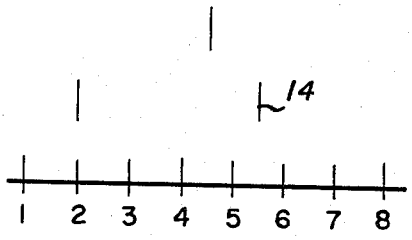

Referring more particularly to FIGS. 1*a* and 1*b* of the drawings, an arrangement having eight output paths is illustrated diagramatically. Thus, N will equal 4, D will be determined by the product of 3.5×S, T will equal the product of 3.5×S, and P, or the number of positions of the shuttle, will equal 8. The full lines designated 10 in FIG. 1*a* show the first position of the shuttle, while the broken lines designated 12 in the same figure indicate the second position of the shuttle. In a like manner, the full line designated 14 in FIG. 1*b* designate a third position of the shuttle. It is believed that the first three positions will reveal the relationship between the shuttles and the eight output paths so that the remaining five positions of the shuttle can be determined.

Figure 2:
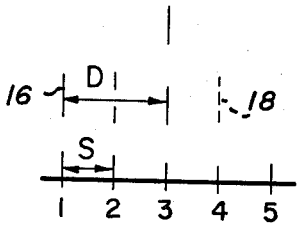

FIG. 2 is similar to FIGS. 1*a* and 1*b* except that only five output paths are provided. Thus, the full lines designated 16 show the first position of the shuttle, while the broken lines designated 18 show the second position. Since the number of outputs is odd, N=2, D=2×S, T=2×S, and there are a total of three positions (P=3).

Figure 3A:
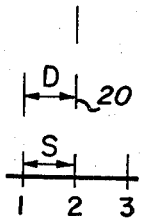
Figure 3B:
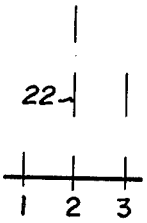

Turning now to FIGS. 3*a* and 3*b*, the relationship is diagrammed between a dual shuttle and an arrangement of only three outputs. Since the number of outputs is odd, N=1, D=1×S, T=1×S, and there are a total of only two positions (P=2). The first of these two positions is shown in FIG. 3*a* and designated by the reference numeral 20 while the second position is illustrated in FIG. 3*b* and designated by the reference numeral 22.

From the above examples, it can be readily appreciated that since neither rail of the dual shuttle discharges to more than half of the associated output paths, the shuttle need travel no more than half the distance between the first and the last output path.

It should be mentioned that although as a practical matter, the spacing S between any two contiguous output paths should be constant, it is possible to have an arrangement where the spacing between the output paths varies. In this case, however, the number of output paths is still either 2N or 2N+1, and the number of positions of the shuttle carriage remains P=2N or P=N+1, respectively. But, D and T cannot be derived as previously set forth. Such implementation would not be as desirable as having uniform spacing of the output paths, inasmuch as the total travel T would be greater than the desirable minimum which is achieved when the spacing S between the output paths is constant and minimum.

Figure 4:
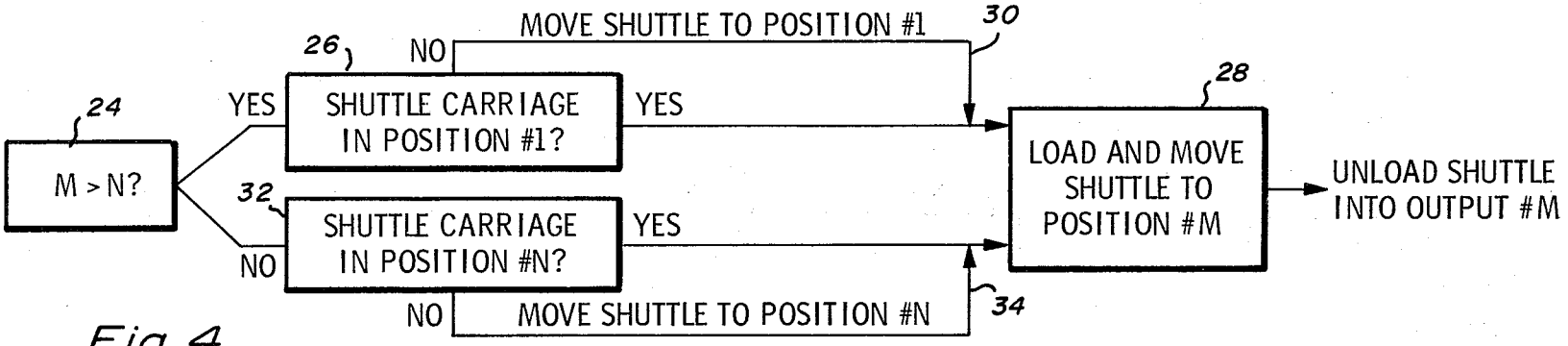
FIG. 4 is a flow chart showing the manner in which components are sorted according to the present invention by apparatus having an even number of output paths.
Figure 5:
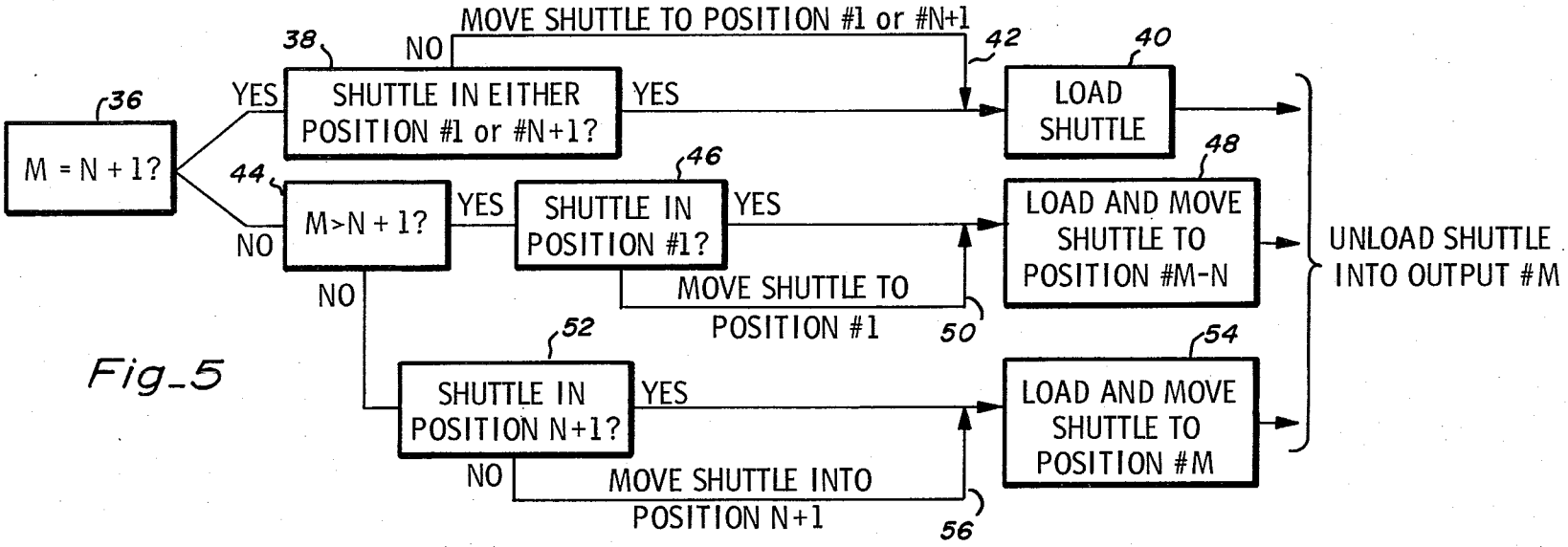
FIG. 5 is a flow chart showing how components are sorted according to the present invention by apparatus having an odd number of output paths.
Figure 9:
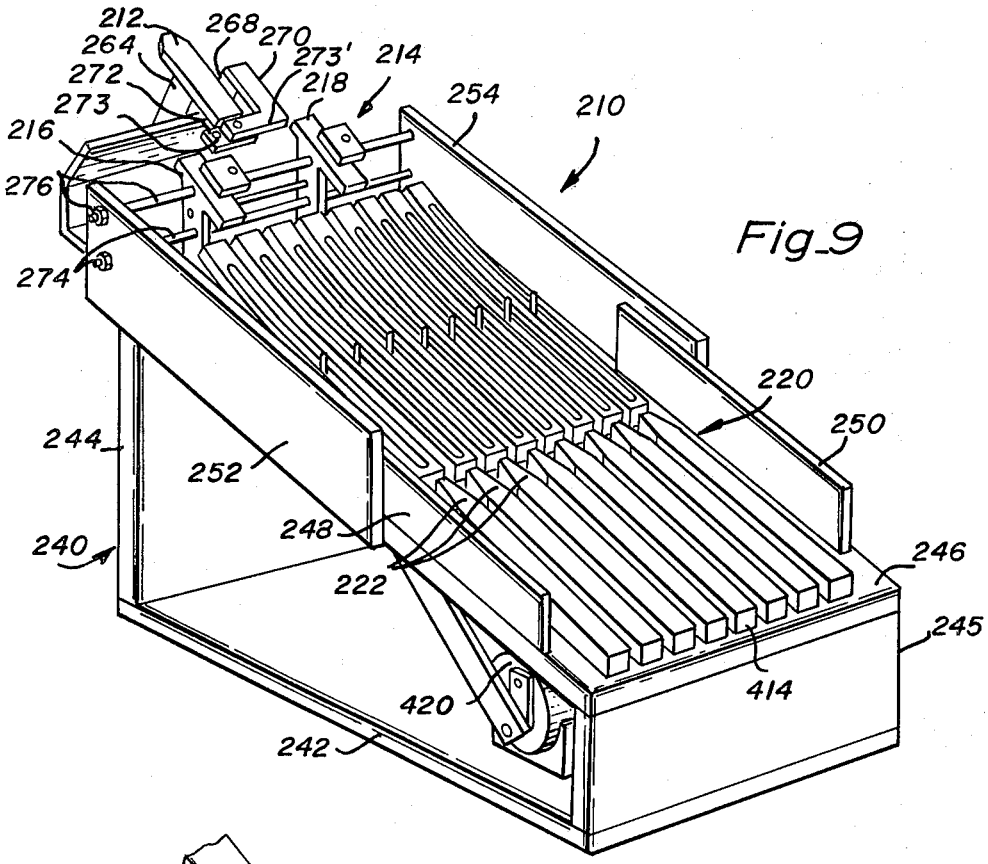
FIG. 9 is a left front perspective view showing another preferred embodiment of component sorting apparatus according to the present invention.
Figure 10:
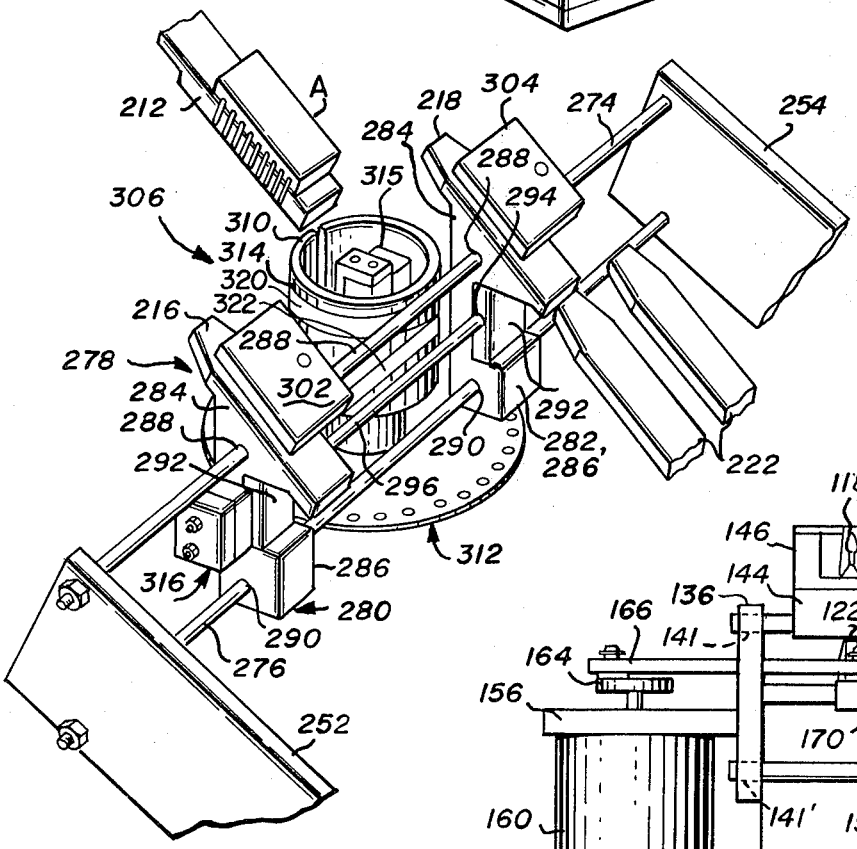
FIG. 10 is a diagramatic, fragmentary, perspective view showing details of the shuttle assembly of the embodiment of FIG. 9.

FIG. 4 of the drawings sets forth a flow chart for component sorting according to the present invention when the apparatus has an even number of output paths, while FIG. 5 shows a similar flow chart for component sorting when the number of output paths is odd.

In FIG. 4, it is desired to sort a component into an output path M. Block 24 represents the question:

Is M greater than N?

If the answer is yes, it is next determined, as represented by block 26, whether the shuttle carriage is in position 1. If the answer again is yes, the component is loaded from the input onto the shuttle and the latter is moved to a position M−N, as represented by block 28. If the answer to the question set forth in block 26 is in the negative, the shuttle must be moved into position 1 as represented by the path 30 going from block 26 to block 28. Now, if the answer to the original question set forth in block 24 was in the negative, it must be determined, as represented by block 32, whether the shuttle carriage is in position N. If the answer to this query is in the affirmative, the component is loaded from the input onto the shuttle and the latter moved to position M, which sequence also is represented by block 28. If the answer to the question set forth in block 32 is in the negative, however, the shuttle must first be moved to position N, as indicated by the path designated 34. Once the block 28 is reached, the component can be loaded on the shuttle which is then moved to position number M for the component to be unloaded into output M as desired.

In FIG. 5, it is desired again to sort a component into an output M. Towards this end, block 36 represents the question:

Is M=N+1?

If the answer to this question is yes, it is then determined if the shuttle carriage is in position 1 or N+1, as represented by block 38. Again, if the answer to the question set forth in block 38 is in the affirmative, the component can be loaded from the input onto the shuttle as represented by block 40 and discharged into output M. If the answer to the question posed in block 38 is in the negative, however, the shuttle must be first moved into position 1 or N+1 as represented by path 42 before the loading step provided for block 40 can be carried out. Now going back to the question posed in block 36, if same is in the negative it must then be determined if M is greater than N+1, as represented by block 44. If so, the next question is whether the shuttle is in position 1, as indicated in block 46. Again, if the answer is in the affirmative, the component can be loaded from the input onto the shuttle and the shuttle moved to position M−N, as represented by block 48. If, however, the answer to any of the questions set forth in blocks 44, 46, 48 is in the negative, additional questions and/or steps must be taken. That is, if the query to the question set forth in block 46 is in the negative, the shuttle must be moved into position 1, as represented by path 50, before the loading and positioning step represented by block 48 can be carried out. Further, if the answer to the question set forth in block 44 is no, it must now be determined if the shuttle is in position N+1, represented by block 52, and if the answer is yes, a component loading and shuttle moving step as represented by block 54 can be carried out. If, however, the answer to the question as set forth in block 52 is in the negative, the shuttle must be moved into position N+1, as indicated by path 56, before the loading and moving step of block 54 can be performed. Once any of the positions represented by a block 40, 48 or 54 is reached, the component can then be discharged to the desired output M.

The above flow charts can be used to program an electronic control system using conventional microprocessors (not shown), and the like, associated with the handler in which a sorting apparatus according to the present invention is inserted to control the operation of the apparatus.

Figure 6:
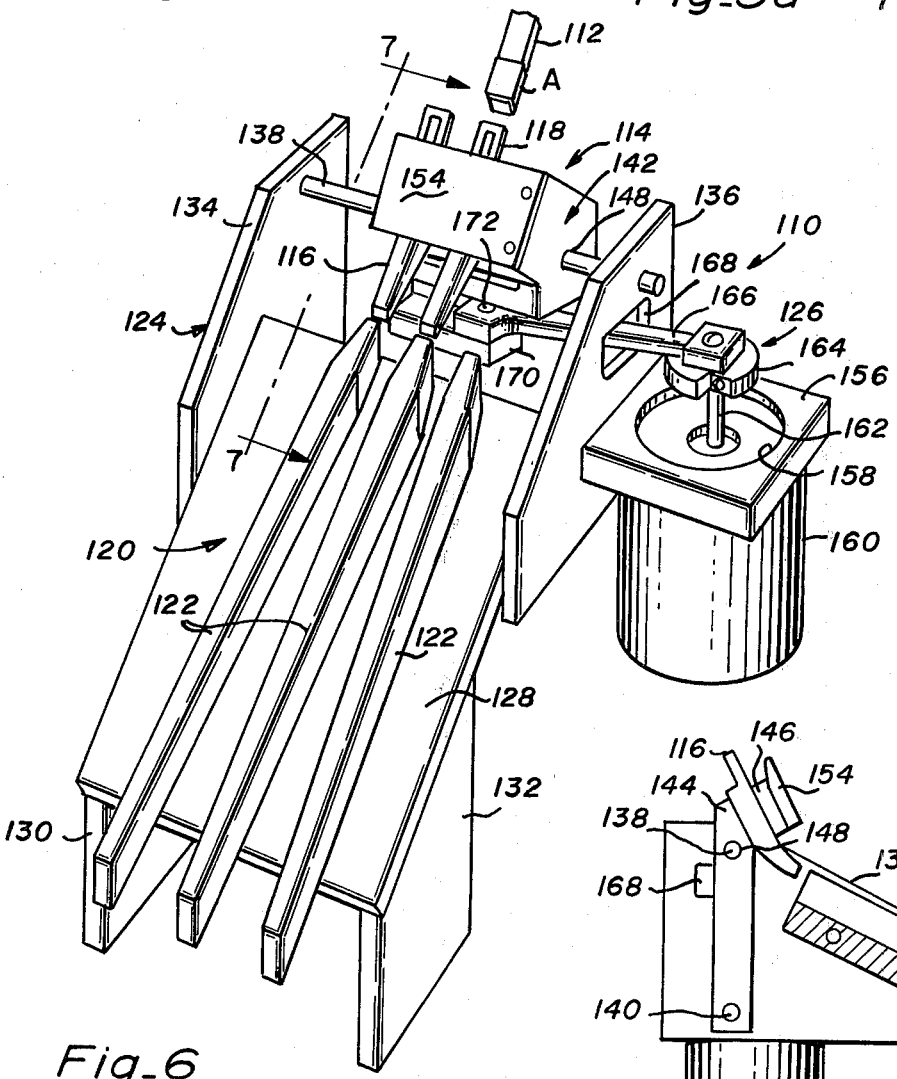
FIG. 6 is a right front perspective view showing one preferred embodiment of component sorting apparatus according to the present invention.
Figure 7:
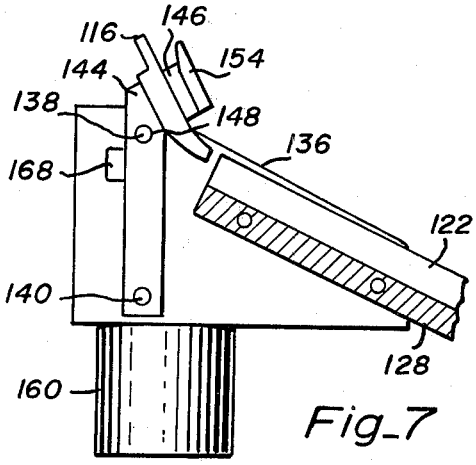
FIG. 7 is a fragmentary, sectional view taken generally along the line 7—7 of FIG. 6.
Figure 8:
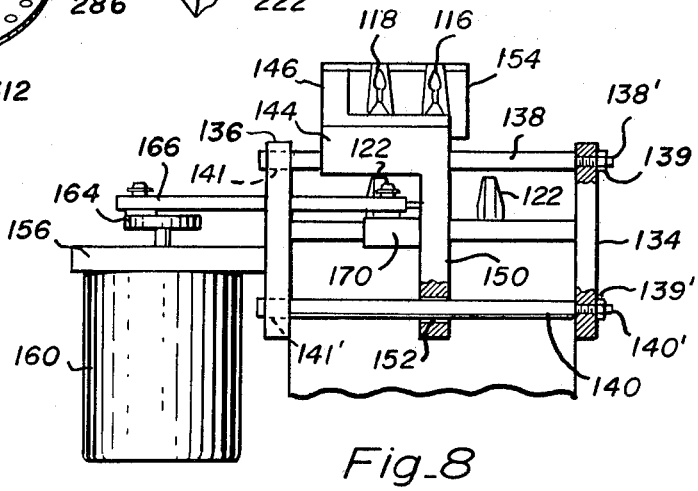
FIG. 8 is a fragmentary, rear elevational view showing the apparatus of FIGS. 6 and 7.
Figure 11:
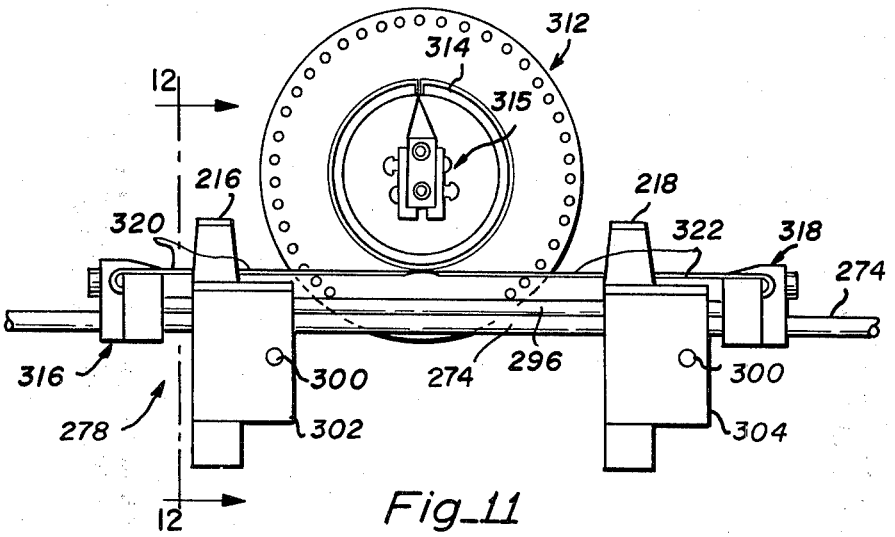
FIG. 11 is a diagramatic, fragmentary, top plan view showing the general area seen in FIG. 10.
Figure 12:
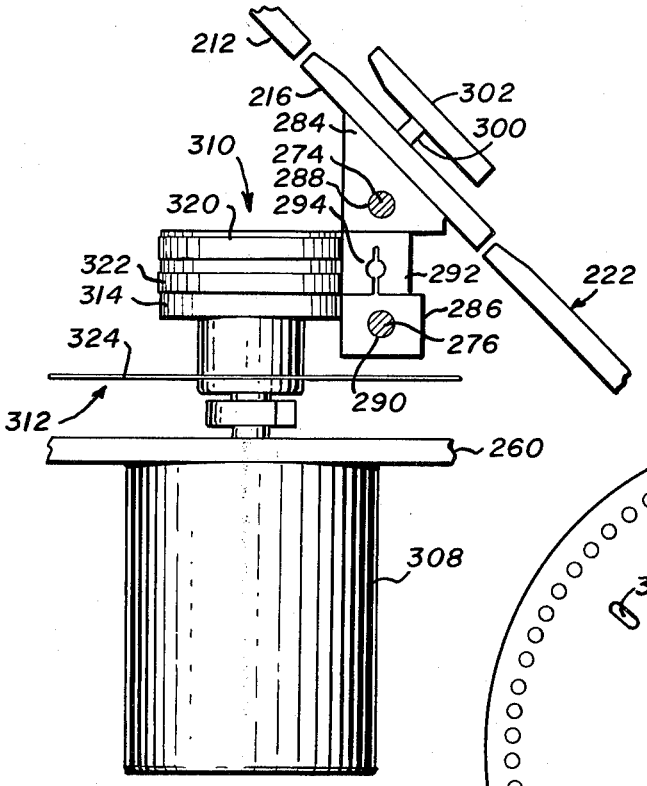
FIG. 12 is a diagramatic, fragmentary, sectional view taken generally along the line 12—12 of FIG. 11.

Embodiment of FIGS. 6 through 8

FIGS. 6–8 of the drawings, illustrate an embodiment of a component sorting apparatus 110 according to the present invention having three outputs as discussed above. Apparatus 110 includes a track 112 arranged for receiving sequentially articles A to be sorted and feeding these articles to a shuttle 114 which comprises a pair of rails 116 and 118 arranged for selectively receiving articles A. An output arrangement 120 including a plurality of slides 122 forming paths for articles A is arranged for receiving articles from rails 116 and 118 of shuttle 114, with each of the rails 116 and 118 being arranged for feeding article to less than all of the paths formed by slides 122.

Track 112 and the slides 122 of output arrangement 120 extends substantially parallel to one another, with the rails 116 and 118 of shuttle 114 being disposed between the track 112 and the output arrangement 120, and arranged for reciprocating movement perpendicular to the extents of the track 112 and the paths of the output arrangement 120. As illustrated, and mentioned above, output arrangement 120 includes three slides 122 with their input ends preferably equally spaced from one another a distance equal to a spacing between the rails 116 and 118 of shuttle 114. The slides 122 preferably diverge at a, for example, 5° angle between adjacent ones for increasing separation and facilitating unloading of articles A.

Shuttle 114 is slideably mounted on a support assembly 124 so as to be reciprocated by a drive arrangement 126 in the direction lateral, or perpendicular, to the extents of track 112 and slides 122. Support assembly 124 includes a substantially planar base plate 128 of rectangular configuration in plan and having an upwardly directed surface on which are disposed the slides 122. Base plate 128 is arranged sloping downwardly from shuttle 114, and has extending downwardly from a lowermost end portion thereof legs 130 and 132 generally trapezoidial in configuration for supporting the lowermost end portion of plate 128 on a suitable horizontal support surface (not shown). Attached to respective edges of plate 128 adjacent the uppermost end portion thereof are a pair of substantially planar side plates 134 and 136 arranged in substantially parallel generally vertical planes for mounting a pair of rods 138 and 140. These rods 138 and 140 have screw threaded stud portions 138′ and 140′ fastened to plate 134 by nuts 139 and 139′ threadably engaging portions 138′, 140′, which extend through holes provided in plate 134, and are inserted into two holes 141 and 141′ provided in plate 136 at other ends thereof.

Rails 116 and 118 are themselves mounted on a carriage 142 having a main portion 144 provided with an opening 148 for slideably receiving rod 138, a side portion 146 substantially perpendicular to portion 144 and a stabilizer portion 150 extending downwardly from main portion 144 and provided with a hole 152 arranged for slideably receiving rod 140. In this manner, it will be appreciated that carriage 142 is slideably mounted on rods 138 and 140 in a stable manner so as to be reciprocated back and forth across the width of output arrangement 120. Further, mounting rails 116 and 118 on carriage 142 disposes the rails 116, 118 in such a manner as to maintain same in a predetermined desired spacing from one another.

The upwardly directed face of the generally vertically disposed side portion 146 of carriage 142 permits mounting thereon of cover plate 154 which extends over a respective rail 116, 118 in order to prevent articles A from lifting off of the associated rail 116, 118 as an article A is moved across with shuttle 114.

A bracket 156 in the form of a planar plate generally square in plan and provided with a circular central opening 158 is cantilever mounted on side plate 136 in a conventional manner, as by the use of screws (not shown). A conventional 45° stepper motor 160 is mounted on the lower surface of bracket 156 such that a shaft 162 of motor 160 extends upwardly centrally of opening 158. Keyed to shaft 162 in a conventional manner for swinging movement thereby is a crank 164 to which is pivotally connected, in spaced relation to shaft 162, one end of a link 166 which passes through a slot 168 provided in side plate 136. The other end of link 166 is pivotally connected to a block 170 as by the illustrated pin 172. Block 170 is in turn affixed to stabilizer portion 150 of carriage 142 along the extent thereof between main portion 144 and the hole 152 provided in portion 150. By this arrangement, a slider-crank mechanism is formed which will cause a rotative movement of shaft 162 of motor 160 to reciprocate block 170, and therefore carriage 142.

A 45° stepper motor as manufactured by Eastern Air Devices, Dover, N.H., No. LD20ABE-2R, is suitable as motor 160.

Alternatively to using the illustrated motor 160 described above, it would be possible to reciprocate carriage 142 as by a single solenoid (not shown) used in combination with a suitable return spring (not shown), or a pair of solenoids in combination where one of the solenoids is energized for one position and the other of the solenoids for the other position.

Embodiment of FIGS. 9 through 12

Referring now more particularly to FIGS. 9–12 of the drawings, an apparatus 210 according to the present invention has a track 212 arranged for receiving sequentially articles A to be sorted and feeding the articles to a shuttle 214 which includes a pair of rails 216 and 218 arranged for selectively receiving articles A from track 212. This embodiment of the present invention has an output arrangement 220 which includes eight slides 222 forming output paths and arranged for receiving articles A from shuttle 214 such that each of the rails 216 and 218 of shuttle 214 feed articles A to less than all of the paths formed by slides 222.

Apparatus 210 is supported on a frame 240 comprising a substantially planar base plate 242 having extending upwardly from spaced ends thereof a pair of vertically disposed end plates 244 and 245, with plate 244 being longer than plate 245 so that a substantially planar bed plate 246 will slope downwardly from shuttle 214. Bed plate 246 has a substantially planar upwardly facing surface on which are arranged the slides 222 of output arrangement 220. Along the substantially parallel peripheral edges of bed plate 246 and toward its lower, or plate 245, end are arranged a pair of side walls 248 and 250. Disposed partially embracing walls 248 and 250 and extending past the uppermost end of bed plate 246 are a pair of side plates 252 and 254 attached to the walls 248 and 250 in a suitable manner, such as by screws (not shown), which serve to support the shuttle 214 in a manner to be described below.

Figure 14:
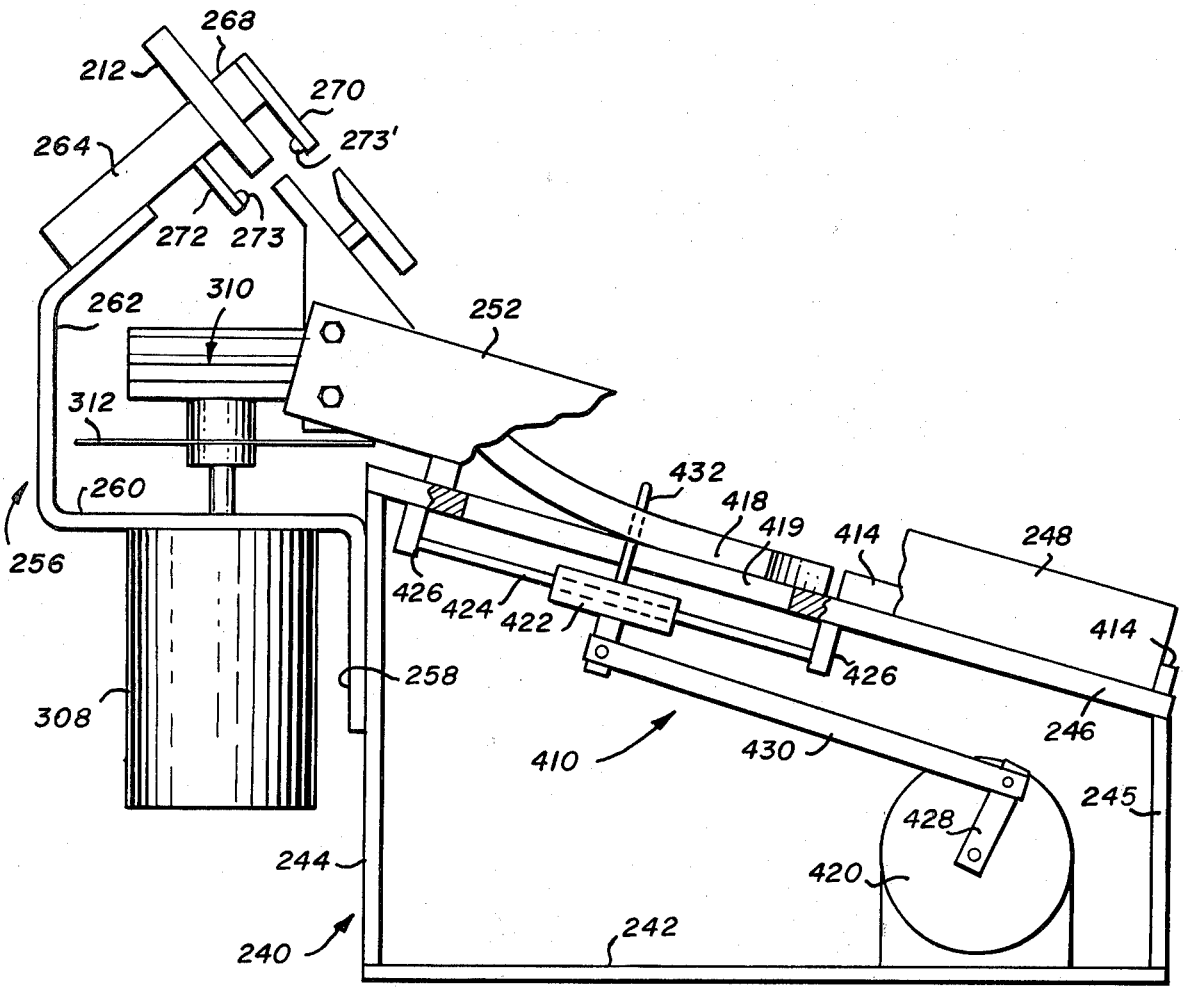
FIG. 14 is a diagramatic, side elevational view, showing the embodiment of FIGS. 9–13, but partly cut away and in section to show details of an advancing system associated with the output arrangement of the apparatus.

Referring to FIG. 14 in conjunction with FIGS. 9–12, it will be seen that a bracket 256 has a substantially vertically disposed portion 258 thereof secured in a suitable manner to an outer surface of end plate 244 so as to support a portion 260 which extends perpendicularly away from both portion 258 and plate 244. A bent portion 262 of bracket 256 extends generally upwardly from portion 260 and has mounted at an upwardly terminal end thereof a support member 264 upwardly on which track 212 is mounted. Also part of support 264 and extending both laterally and upwardly therefrom is a portion 268 on which are attached two L-shaped printed circuit boards 270 and 272 on which are mounted complementing photo electric cells 273 and 273' for detecting passage of article A to shuttle 214.

Side plates 252 and 254 support a pair of substantially vertically displaced, parallel rods 274 and 276 arranged for slideably supporting a carriage 278 on which rails 216 and 218 are mounted. Carriage 278 is formed by a pair of substantially identical rail mounting blocks 280 and 282 each comprising an upper portion 284 and a lower portion 286 provided with through bores 288 and 290, respectively, for slideably receiving rods 274 and 276. Intermediate the portions 284 and 286 of each mounting block 280, 282 is a clamp portion 292 provided with a slotted arrangement 294 which clampingly receives an associated end of a longitudinally extending bar 296 that fixes the two mounting blocks 280 and 282 in spaced relation to one another. The upper portions 284 of each of the blocks 280 and 282 is provided with a laterally extending edge 298 in which is formed a socket for receiving a pin 300 arranged for supporting a respective cover plate 302 and 304 extending over an associated one of the rails 216 and 218 for retaining articles A on the associated rail as the articles are being transferred by shuttle 214.

Apparatus 210 further includes a drive assembly 306 arranged for reciprocating carriage 278 and comprising a conventional motor 308 supported on portion 260 of bracket 256, which portion has a central opening for receiving the conventionally provided upward shaft of motor 308, and a capstan 310 rotatably affixed to motor 308 and connected to carriage 278 for reciprocating same. The rotation of motor 308 is controlled by an encoder 312 disposed on a lower part of capstan 310 for rotation therewith. Construction of encoder 312 will be described in greater detail below.

Capstan 310 includes a hollow, slotted drum 314 having a conventional clamp 315 disposed internally thereof and rotatably disposed between rails 216 and 218 of shuttle 214. A pair of conventional clamps 316 and 318 are mounted at respective ends of bar 296 so as to be outside of associated blocks 280 and 282 of carriage 278. A first flexible belt 320 is attached to clamp 315 of drum 314, passed out of a slot provided in drum 314, wrapped around the outer cylindrical surface of drum 314, and attached to clamp 316. In a like manner, a second belt 322 is attached at one end thereof to clamp 315, wrapped partially around the other surface of drum 314, and secured to clamp 318. By arranging belts 320 and 322 so that they wind and unwind on the surface of drum 314 in directions opposite to one another, rotation of the drum 314 will wind one belt 320, 322 while unwinding the other belt 322, 320, thus causing carriage 278 to reciprocate. It has been found satisfactory to construct belts 320 and 322 from stainless steel, and the like, of a thickness of, for example, approximately 0.005 inch.

Description of the Encoder

Figure 13:
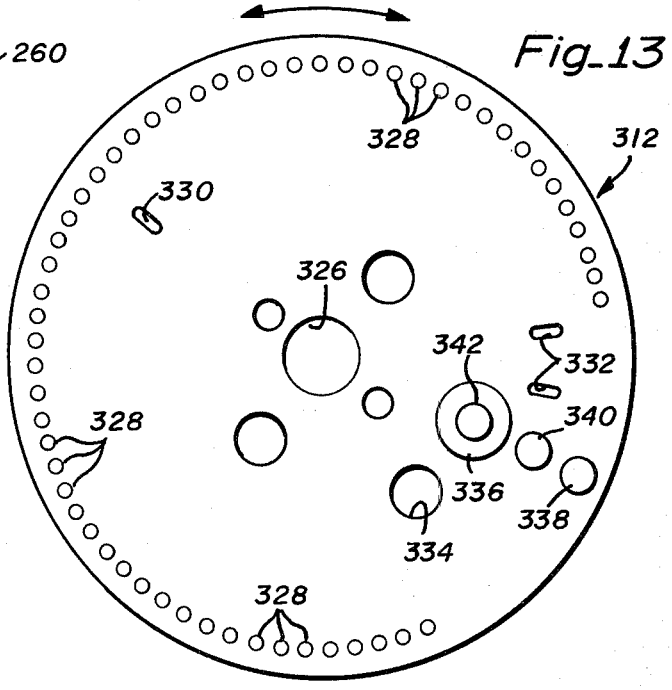
FIG. 13 is a top plan view showing an encoder disk for use with the embodiment of the invention illustrated in FIGS. 9–12.

Referring now to FIG. 13 of the drawings, there is illustrated a light chopper which can be used as encoder 312. This device includes a disk 324 having a plurality of centrally disposed holes 326 which faciliate mounting of the disk to the lower portion of capstan 310, and about the outer circular periphery thereof a plurality of apertures 328 which form the basic position indicating line of encoder 312. Provided in disk 324 on a circle of lesser radius than the circle on which apertures 328 are disposed are a plurality of slots 330 and 332, with slot 330 being a home slot and the two slots 332 being arranged to perform an initialization function. Openings 334 and 336 are arranged on a circle of still lesser radius than those on which slots 330 and 332 are disposed to perform an emergency function as will become apparent below.

Photo sensors 338, 340, and 342 are arranged radially from the center of disk 324 so as to be stationed on the three aforementioned circles of apertures 328, slots 330 and 332, and openings 334 and 336, respectively, as is shown diagramatically in FIG. 13. These photo sensors are connected to motor 308 through an electronic control system (not shown) of a conventional nature and commonly used for such functions. The photo sensors 340 will stop counterclockwise rotation of disk 324 as seen in the figure when slots 332 are detected in sequence, while the home slot 330 permits the control system to check the position of capstan 310 as it swings back and forth between clockwise and counterclockwise rotation. The apertures 328 sequentially block and unblock light to photo sensors 338, thus forming an analog to degrees of rotation of disk 324. Accordingly, the control system (not shown) need only know how many apertures must be detected by photo sensors 338 to move carriage 278 to a desired output slide 222 in order to move the appropriate rail 216, 218 to the proper location.

Capstan 310 moves at such a rapid rate that there is a possibility of it rotating beyond its intended limits, thus essentially destroying motor 308 and possibly sustaining additional damage to apparatus 210. For this reason, therefore, photo sensors 342 are provided so as to detect the presence of emergency openings 334 and 336. Normally, these openings 334 and 336 should never come into the path of photo sensors 342, but if they should it will be an indication that disk 324 has, for whatever reason, rotated beyond its intended limits and the entire apparatus 210 will immediately be shut down in a conventional manner to avoid further damage to the device.

Description of the Advancing System

Figure 15:
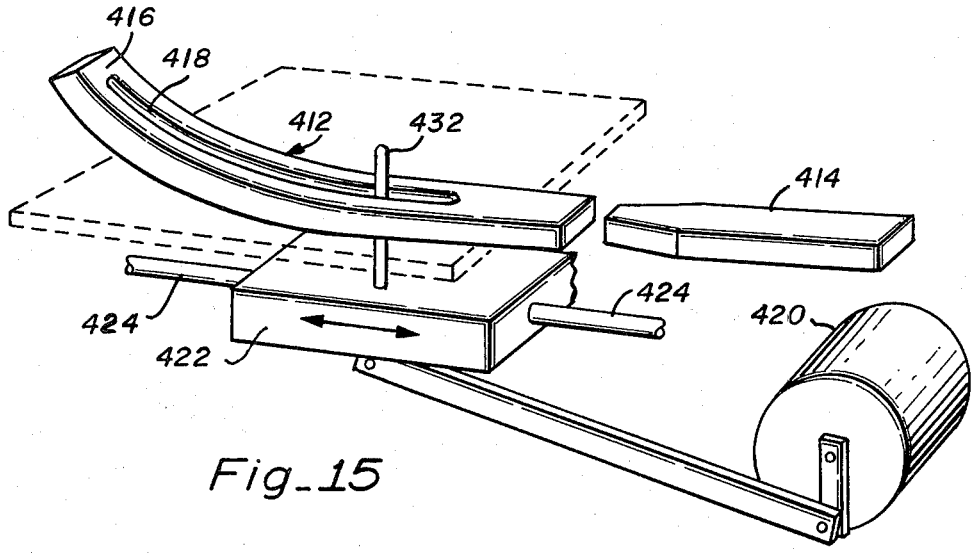
FIG. 15 is a diagramatic, perspective view showing in greater detail than in FIG. 14 parts of the component advancing system according to the present invention.

FIGS. 14 and 15 show an advancing system 410 preferably employed with the output arrangement 220 of sorting apparatus 210. This system 410 is particularly advantageous when sorting the larger, and heavier, integrated circuits, since the momentum of these components can be such as to cause damage to themselves if permitted to slide along output arrangement 220 under the force of gravity acting on their own mass. Thus, it is preferable not to orient the slides 222 with sufficient downward slope to permit these larger integrated circuits to slide without assistance.

Advancing system 410 includes a section 412 curving downwardly from shuttle 314 and leading into the diverging end of a lower section 414 of each of the slides 222. Section 412 has an upwardly facing concave surface 416 provided with slots 418 which will, it will be appreciated, have a counterpart 419 in bed plate 246 of apparatus 210. These slots 418 extend longitudinally along the paths formed by slide sections 412, with the latter being upwardly curved for permitting the articles A to slide to a position over slots 418.

Advancing system 410 further includes a conventional electric motor 420, and the like, mounted on base plate 242 of frame 240 of apparatus 210 for reciprocating a sliding member 422 moveably disposed on at least one slide guide 422 retained in a pair of spaced blocks 426 mounted on the under surface of bed plate 246 so as to be oriented parallel to slots 418. A crank 428 is affixed to the upward shaft of motor 420 and pivotally attached to one end of a link 430 which is pivotally attached at the other end thereof to the under surface of sliding member 422 as by the illustrated lug. A plurality of pins 432 extend upwardly from an upper surface of sliding member 422 for reciprocating motion therewith and pass through the slots 419 to engage in the slots 418 of slide sections 412 in such a manner that the upward curve of sections 412 will cause pins 432 to retract beneath surface 416 of sections 412 when pins 432 are in a position closest to shuttle 214. In this manner, the pins 432 will permit an article A to slide down and rest on a particular slide section 412 over a slot 418 provided therein when the pins 432 move to an end position in the direction of shuttle 214. Conversely pin 432 will extend above the surface 416 of the associated section 412 so as to engage and positively move the article A when pins 432 move away from shuttle 214. This positive enagement and movement of the components will assure that they move at the proper rate of speed and momentum and will not be damaged when they come to rest somewhere on slide section 414.

It will be appreciated that although not specifically disclosed herein, the bottom portions of both slides 122 and 222 will have provided thereon some sort of conventional stop arrangement to retain the sorted components until it is desired to remove them from the associated apparatus. Removal is usually accomplished by use of the tubes, sleeves, magazines, and the like, conventionally employed for storing and handling integrated circuits.

Closing Comments

As can be readily understood from the above description and from the drawings, component sorting apparatus according to the present invention provides a relatively small, rigid, easily aligned unit capable of fast and reliable sorting of integrated circuits and similar articles in a safe and efficient manner. For example, the relatively short travel distance of the dual shuttles according to the present invention requires a travel time of only 60 milli-seconds in a typical application; and by way of comparison, a capstan used to reciprocate the shuttle carriage need be only one half the size of a capstan used with only a single rail shuttle. Further, while the motor used with a typical single rail shuttle application has been, for example, of 375 watts rating, a 175 watt motor can satisfactorily reciprocate a dual shuttle according to the invention used in the same manner.

Whereas, the preferred embodiment of the present invention has been described above, it is contemplated that other alterations and modifications may become apparent to those skilled in the art after having read the above disclosure. It is therefore intended that the appended claims be interpreted as covering all such alterations and modifications as fall within the true spirit and scope of the invention.

What is claimed is:

1. A component sorting apparatus comprising:

track means for receiving one at a time articles to be sorted;

shuttle means including a pair of rails and support means having spacing means for holding said rails in spaced apart relationship, and at least one rod means, said rails and said spacing means being slideably moveable as a unit along said rod means so that said rails may be positioned in alignment with said track means to receive articles therefrom, and drive means for selectively positioning said rail means relative to said track means; and output means forming at least three paths equally spaced from one another by distances which are a function of the spacing between said rails, and for receiving articles from said shuttle means, the direction of extent of said track means and the paths of said output means extending substantially parallel to one another, with said rails being disposed between said track means and the paths of said output means and arranged for reciprocating movement in a direction transverse to the direction of extent of said track means and the paths of said output means, the respective ones of said rails being arranged for movement into positions for feeding articles received from said track means to less than all of the paths of said output means.

2. Apparatus as defined in claim 1 wherein said drive means includes a 45° stepper motor having an axle defining an axis of rotation of said motor, a crank attached to said axle of said stepper motor for swinging movement thereby, and a link pivotally connected to said crank and to said rails of said shuttle means, said crank, link, and slideably mounted rails forming a slide-crank mechanism.

3. Apparatus as defined in claim 1 wherein said drive means includes:

(a) a motor;

(b) capstan means rotatably affixed to said motor and connected to said rails of said shuttle means for reciprocating said rails; and (c) encoder means connected to said capstan means for controlling movement of same.

4. Apparatus as defined in claim 3 wherein said capstan means includes a rotatable drum disposed between said rails of said shuttle means, a first flexible belt attached to said drum and affixed to a one of said rails, and a second flexible belt attached to said drum and affixed to the other of said rails, said first belt winding and unwinding on said drum in a direction opposite to that of said second belt, rotation of said drum winding one said belt and unwinding the other said belt and causing said rails to reciprocate.

5. Apparatus as defined in claim 4 wherein said output means further includes a plurality of substantially parallel slides forming the paths of said output means, and advancing means associated with said slides for positively engaging articles being sorted and for moving the articles along said paths formed by said slides.

6. Apparatus as defined in claim 5 wherein said slides each have a curved section extending downwardly from said shuttle means and provided with an upwardly facing concave surface each said slide being further provided with a slot extending along a corresponding path, and wherein said advancing means comprises, in combination:

(a) motive means;

(b) sliding member means attached to said motive means for being reciprocated thereby toward and away from said shuttle means; and (c) pin means mounted on said sliding member means for reciprocating motion therewith and engaged in said slots provided in said slides, said pin means being retracted beneath the upwardly facing surface of each said slide when disposed closest to said shuttle means, due to the curved section of said slides, and extending upwardly through said slots when moved away from said shuttle means for engaging articles being sorted and moving the articles along said slides away from said shuttle means.

7. An apparatus as defined in claim 1 wherein said output means further includes a plurality of substantially parallel slides forming the paths of said output means, and advancing means associated with said slides for positively engaging articles being sorted and moving the articles along said paths formed by said slides.

8. Apparatus as defined in claim 7 wherein said slides each have a curved section extending downwardly from said shuttle means and provided with an upwardly facing concave surface and provided in said section with a slot extending along a respective one of said paths formed by said slides, the advancing means comprising, in combination:

(a) motive means;

(b) sliding member means attached to said motive means for being reciprocated thereby toward and away from said shuttle means; and (c) pin means mounted on said sliding member means for reciprocating motion therewith and engaged in said slots provided in said slides for retracting beneath the upwardly facing surface of each said slides when disposed closest to said shuttle means due to the curved section of said slides, and for engaging an article being sorted and moving the article away from said shuttle means.

9. Apparatus as defined in claim 7 wherein said drive means includes a 45° stepper motor having an axle defining an axis of rotation of said motor, a crank attached to said axle of said 45° stepper motor for swinging movement thereby, and a link pivotally connected to said crank and to said rails of said shuttle means, said crank, link, and slideably mounted rails forming a slide-crank mechanism.

10. Apparatus as defined in claim 7 wherein said drive means includes:

(a) a motor;

(b) capstan means rotatably affixed to said motor and connected to said rails of said shuttle means for reciprocating said rails; and (c) encoder means connected to said capstan means for controlling movement of same.

11. Apparatus as defined in claim 10 wherein said capstan means includes a rotatable drum disposed between said rails of said shuttle means, a first flexible belt attached to said drum and affixed to a one of said rails, and a second flexible belt attached to said drum and affixed to the other of said rails, said first belt winding and unwinding on said drum in a direction opposite to that of said second belt, rotation of said drum winding one said belt and unwinding the other said belt and causing said rails to reciprocate.

* * * * *